US011021665B1

(12) United States Patent
Koseoglu

(10) Patent No.: US 11,021,665 B1
(45) Date of Patent: Jun. 1, 2021

(54) TWO-STAGE RECYCLE HYDROCRACKING PROCESSES

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/859,116

(22) Filed: Apr. 27, 2020

(51) Int. Cl.
*C10G 67/02* (2006.01)
*C10G 75/00* (2006.01)

(52) U.S. Cl.
CPC ..... *C10G 67/02* (2013.01); *C10G 75/00* (2013.01); *C10G 2300/1074* (2013.01); *C10G 2300/201* (2013.01); *C10G 2300/202* (2013.01); *C10G 2300/301* (2013.01); *C10G 2300/307* (2013.01); *C10G 2300/308* (2013.01); *C10G 2300/4006* (2013.01); *C10G 2300/4012* (2013.01); *C10G 2300/4018* (2013.01); *C10G 2300/4075* (2013.01); *C10G 2300/4081* (2013.01); *C10G 2300/70* (2013.01)

(58) Field of Classification Search
USPC ..... 422/139, 147, 140; 196/46; 208/58, 59, 208/48 R, 72
See application file for complete search history.

(56) References Cited

U.S. PATENT DOCUMENTS 4,381,987 A 5/1983 Kuehler
4,447,315 A 5/1984 Lamb et al.
4,954,242 A 9/1990 Gruia
5,190,633 A * 3/1993 Fetzer ..... C10G 67/06 208/310 R
5,464,526 A * 11/1995 Saunders ..... C10G 67/06 208/108
7,763,163 B2 * 7/2010 Koseoglu ..... C10G 67/06 208/99
8,343,334 B2 * 1/2013 Koseoglu ..... C10G 65/10 208/59
8,828,219 B2 9/2014 Koseoglu
9,101,853 B2 8/2015 Koseoglu et al.
9,101,854 B2 8/2015 Koseoglu et al.
9,394,493 B2 7/2016 Koseoglu
9,534,179 B2 1/2017 Koseoglu
9,701,912 B2 * 7/2017 Hoehn ..... C10G 45/54
10,011,786 B1 * 7/2018 Eizenga ..... B01D 15/1814
(Continued)

*Primary Examiner* — Nina Bhat
(74) *Attorney, Agent, or Firm* — Dinsmore & Shohl LLP

(57) ABSTRACT

A two-stage recycle hydrocracking process may comprise hydrocracking at least a portion of a hydrocarbon feed to produce a first hydrocracked effluent, separating the first hydrocracked effluent into at least four separated effluents, hydrocracking at least a portion of the fourth separated effluent to produce a second hydrocracked effluent, and cooling the second hydrocracked effluent to a temperature less than or equal to 250 degrees Celsius to produce a cooled effluent. The second hydrocracking effluent may have a total concentration of aromatic compounds sufficient to maintain the solubility of heavy polynuclear aromatics in the second hydrocracked effluent and reduce precipitation of the heavy polynuclear aromatics in the second hydrocracked effluent. Processes for reducing or preventing the precipitation of heavy polynuclear aromatics during hydrocracking are also described.

20 Claims, 1 Drawing Sheet

(56) References Cited

U.S. PATENT DOCUMENTS

| | | | | |
|---|---|---|---|---|
| 10,479,947 | B2 * | 11/2019 | Macris | C10G 67/049 |
| 10,513,664 | B1 * | 12/2019 | Koseoglu | C10G 65/18 |
| 2018/0155643 | A1 * | 6/2018 | Al-Ghamdi | C10G 69/06 |
| 2018/0187100 | A1 * | 7/2018 | Koseoglu | C10G 55/06 |

* cited by examiner

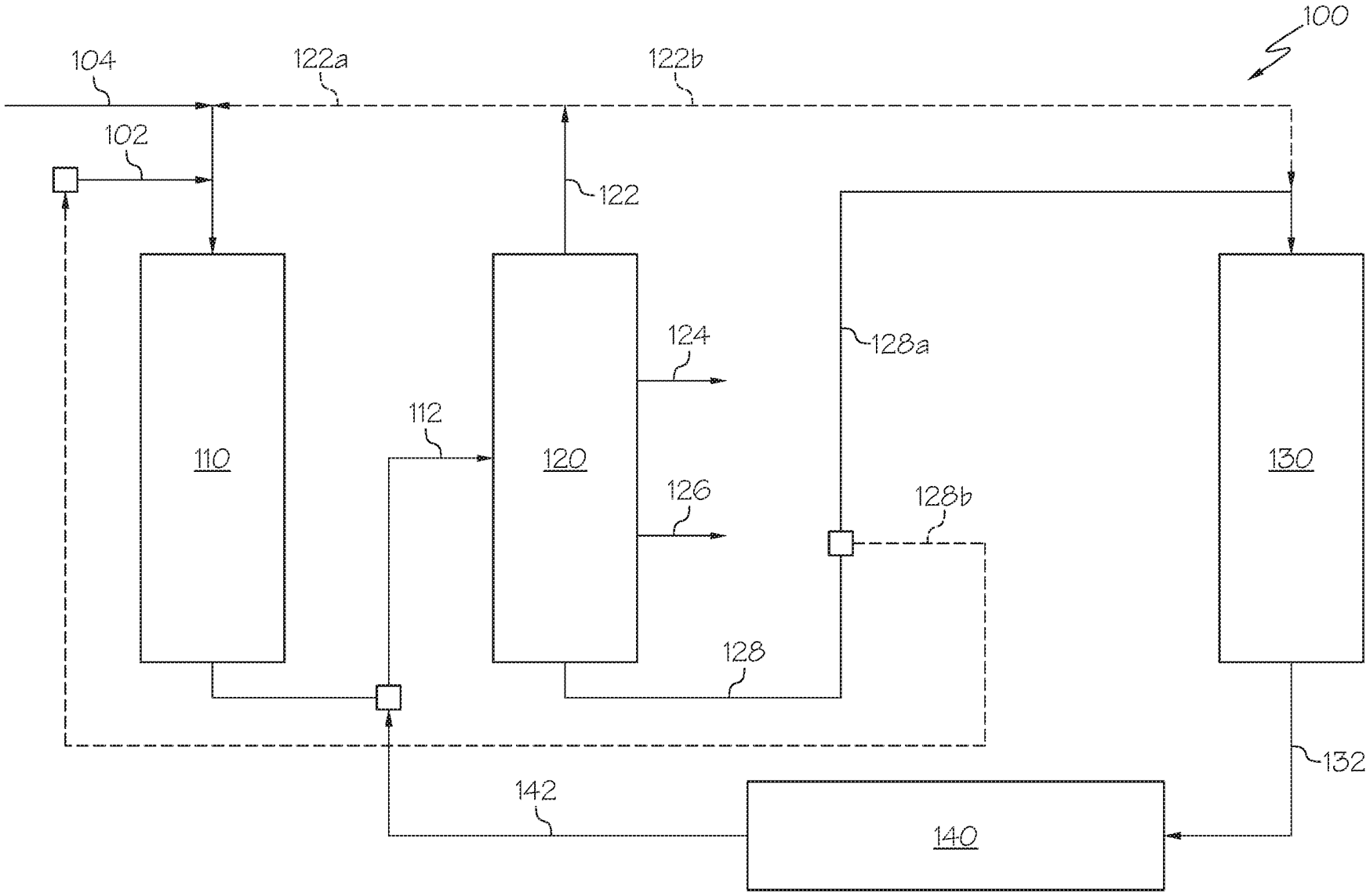
100
130
132
140
128b
128a
128
124
126
122b
122
120
142
112
122a
110
102
104

TWO-STAGE RECYCLE HYDROCRACKING PROCESSES

BACKGROUND

Field

The present disclosure relates to systems and processes for processing petroleum-based materials and, in particular, systems and processes for upgrading or converting petroleum-based materials to petrochemical products through hydrocracking.

Technical Background

Petroleum-based materials can be converted to petrochemical products, such as fuel blending components, olefins, and aromatic compounds, which are basic intermediates for a significant portion of the petrochemical industry. The increasing worldwide demand for olefins and aromatic compounds remains a major challenge for many integrated refineries. In particular, olefins are considered the building blocks of polymer synthesis and, as a result, the demand for the production of particularly valuable olefins, such as ethylene, propene, and butene, has increased significantly in recent years. Additionally, aromatic compounds are used as intermediates for polymer synthesis and the production of other organic compounds, such as fuel additives, which has resulted in a similar increase in demand for the production of valuable aromatic compounds, such as benzene, toluene, ethylbenzene, and xylene.

Petroleum-based materials may be converted into petrochemical products through hydrocracking. Generally, hydrocracking encompasses processes that simultaneously crack and hydrogenate hydrocarbons to produce products with lighter molecular weights and increased hydrogen to carbon ratios. Typical hydrocarbon feeds for hydrocracking processes, such as vacuum gas oil (VGO), comprise minor amounts of small polynuclear aromatic hydrocarbons (PAH); however, larger polynuclear aromatic hydrocarbons, referred to as heavy polynuclear aromatics (HPNA), can form during hydrocracking processes and can be present in significant concentrations in the heavier fractions of hydrocracked effluents. Heavy polynuclear aromatics are typically formed by the dehydrogenation of aromatic hydrocarbons or the cyclization of side chains onto existing polynuclear aromatic hydrocarbons, which is followed by dehydrogenation. Generally, the amount of heavy polynuclear aromatics formed during a hydrocracking process correlates directly to the severity of the hydrocracking process. The formation of heavy polynuclear aromatics may result in the precipitation and buildup of heavy polynuclear aromatics, which can cause the fouling of components of the hydrocracking system and downstream process equipment. Conventional methods to reduce or prevent such fouling include adsorption, hydrogenation, extraction, and purging. However, these methods may require cost-intensive modifications to typical hydrocracking systems, a reduction of the yield of petrochemical products, such as fuel blending components, olefins, or aromatic compounds.

SUMMARY

Accordingly, there is an ongoing need for systems and processes for upgrading or converting petroleum-based materials to petrochemical products through hydrocracking while also reducing or preventing the precipitation and buildup of heavy polynuclear aromatics, which can cause fouling of components of the hydrocracking system and downstream process equipment. The systems and processes of the present disclosure may reduce or prevent the precipitation and buildup of heavy polynuclear aromatics by increasing the solubility of heavy polynuclear aromatics in the hydrocracked effluent. The solubility of heavy polynuclear aromatics in the hydrocracked effluent may be increased by increasing the concentration of aromatic compounds in the hydrocracked effluent through reducing the saturation of aromatic compounds during hydrocracking. The increase in concentration of aromatic compounds may increase the solvency of the hydrocracked effluent with respect to the heavy polynuclear aromatic compounds. This increase in solubility of heavy polynuclear aromatics in the hydrocracked effluent may reduce or prevent the precipitation of heavy polynuclear aromatics during hydrocracking processes, particularly when the hydrocracked effluent is cooled after being passed out of the hydrocracking unit.

According to at least one aspect of the present disclosure, a two-stage recycle hydrocracking process may comprise hydrocracking at least a portion of a hydrocarbon feed to produce a first hydrocracked effluent, separating the first hydrocracked effluent into at least a first separated effluent, a second separated effluent, a third separated effluent, and a fourth separated effluent, hydrocracking at least a portion of the fourth separated effluent to produce a second hydrocracked effluent, and cooling the second hydrocracked effluent to a temperature less than or equal to 250 degrees Celsius to produce a cooled effluent. The third separated effluent may have a cetane index of from 46 to 70 and a total concentration of aromatic compounds of from 1 weight percent to 30 weight percent based on the total weight of the third separated effluent. The second hydrocracking effluent may have a concentration of heavy polynuclear aromatics of from 50 parts per million by weight to 5000 parts per million by weight and a total concentration of aromatic compounds of from 1 weight percent to 20 weight percent based on the total weight of the second hydrocracked effluent. The concentration of aromatic compounds of from 1 weight percent to 20 weight percent in the second hydrocracked effluent may maintain the solubility of the heavy polynuclear aromatics in the second hydrocracked effluent and reduce precipitation of the heavy polynuclear aromatics in the second hydrocracked effluent.

According to at least one aspect of the present disclosure, a process for reducing or preventing the precipitation of heavy polynuclear aromatics during hydrocracking may comprise introducing a hydrocarbon feed and hydrogen to a first hydrocracking unit operable to contact the hydrocarbon feed with the hydrogen in the presence of at least a first hydrocracking catalyst to produce a first hydrocracked effluent. The process may further comprise passing the first hydrocracked effluent to a separation unit downstream of the first hydrocracking unit. The separation unit may be operable to separate the first hydrocracked effluent to produce at least a first separated effluent, a second separated effluent, a third separated effluent, and a fourth separated effluent. The process may further comprise passing at least a portion of the fourth separated effluent and hydrogen to a second hydrocracking unit downstream of the separation system. The second hydrocracking unit may be operable to contact the fourth separated effluent and the hydrogen in the presence of at least a second hydrocracking catalyst to produce a second hydrocracked effluent. The process may further comprise maintaining the first hydrocracking unit, the second hydrocracking unit, or both, at operating conditions to produce the third separated effluent having a cetane index of from 46 to 70 and a total concentration of aromatic compounds of from 1 weight percent to 30 weight percent based on the total weight of the third separated effluent, and the second hydrocracking effluent having a concentration of heavy polynuclear aromatics of from 50 parts per million by weight to 5000 parts per million by weight and a total concentration of aromatic compounds of from 1 weight percent to 20 weight percent based on the total weight of the second hydrocracked effluent. The concentration of aromatic compounds of from 1 weight percent to 20 weight percent in the second hydrocracked effluent maintains the solubility of the heavy polynuclear aromatics in the second hydrocracked effluent and reduces precipitation of the heavy polynuclear aromatics in the second hydrocracked effluent.

Additional features and advantages of the aspects of the present disclosure will be set forth in the detailed description that follows and, in part, will be readily apparent to a person of ordinary skill in the art from the detailed description or recognized by practicing the aspects of the present disclosure.

BRIEF DESCRIPTION OF THE DRAWINGS

The following detailed description of the present disclosure may be better understood when read in conjunction with the following drawing in which:

FIG. 1 schematically depicts a generalized flow diagram of a two-stage recycle hydrocracking system, according to one or more aspects of the present disclosure.

When describing the simplified schematic illustration of FIG. 1, the numerous valves, temperature sensors, electronic controllers, and the like, which may be used and are well known to a person of ordinary skill in the art, are not included. Further, accompanying components that are often included in systems such as those depicted in FIG. 1, such as air supplies, heat exchangers, surge tanks, and the like are also not included. However, a person of ordinary skill in the art understands that these components are within the scope of the present disclosure.

Additionally, the arrows in the simplified schematic illustration of FIG. 1 refer to process streams. However, the arrows may equivalently refer to transfer lines, which may transfer process steams between two or more system components. Arrows that connect to one or more system components signify inlets or outlets in the given system components and arrows that connect to only one system component signify a system outlet stream that exits the depicted system or a system inlet stream that enters the depicted system. The arrow direction generally corresponds with the major direction of movement of the process stream or the process stream contained within the physical transfer line signified by the arrow.

The arrows in the simplified schematic illustration of FIG. 1 may also refer to process steps of transporting a process stream from one system component to another system component. For example, an arrow from a first system component pointing to a second system component may signify "passing" a process stream from the first system component to the second system component, which may comprise the process stream "exiting" or being "removed" from the first system component and "introducing" the process stream to the second system component.

Moreover, two or more lines intersecting in the simplified schematic illustration of FIG. 1 refers to two or more process streams being "mixed" or "combined". Mixing or combining two or more process streams may comprise mixing or combining by directly introducing both streams into a like reactor, separation device, or other system component. For example, two lines intersecting prior to entering a system component may signify the introduction of the two process streams into the system component, in which mixing or combining occurs.

Reference will now be made in greater detail to various aspects, some of which are illustrated in the accompanying drawings.

DETAILED DESCRIPTION

The present disclosure is directed to systems and processes for upgrading or converting petroleum-based materials to petrochemical products through hydrocracking. There are three general processes for hydrocracking: single-stage once-through hydrocracking, series-flow hydrocracking, and two-stage recycle hydrocracking. Both single-stage once-through hydrocracking and series-flow hydrocracking typically comprise passing a hydrocarbon feed through one or more hydrocracking units, arranged in series. Single-stage once-through hydrocracking typically only comprises the passing of the hydrocarbon feed through the hydrocracking system a single time, and series-flow hydrocracking typically comprises passing the entire hydrocracked effluent from one hydrocracking unit to the next. Two-stage recycle hydrocracking typically comprises passing a hydrocarbon feed through at least two hydrocracking units, where only the fraction with the greatest atmospheric boiling point of the effluent from the first hydrocracking unit is passed to the second hydrocracking unit. Since the first hydrocracking unit typically accomplishes both hydrotreating and hydrocracking to some degree, the feed passed to the second hydrocracking unit is virtually free of impurities, which allows for the use of catalysts with greater functionality in the second hydrocracking unit.

Referring to FIG. 1, a two-stage recycle hydrocracking system 100 of the present disclosure for upgrading or converting a hydrocarbon feed 102 through hydrocracking is schematically depicted. The system 100 may comprise a first hydrocracking unit 110, a separation unit 120 downstream of the first hydrocracking unit 110, a second hydrocracking unit 130 downstream of the separation unit 120, and a heat transfer unit 140 downstream of the second hydrocracking unit 130. A two-stage recycle hydrocracking process may comprise hydroprocessing a hydrocarbon feed 102 to produce a first hydrocracked effluent 112, where hydroprocessing may include hydrocracking or both hydrotreating and hydrocracking. Additionally, the process may comprise separating the first hydrocracked effluent 112 into at least a first separated effluent 122, a second separated effluent 124, a third separated effluent 126, and a fourth separated effluent 128. The process may further comprise hydroprocessing the fourth separated effluent 128 to produce a second hydrocracked effluent 132 having a concentration of heavy polynuclear aromatics of from 50 parts per million by weight (ppmw) to 5000 ppmw and total concentration of aromatic compounds of from 1 weight percent (wt. %) to 20 wt. % based on the total weight of the second hydrocracked effluent 132, where hydroprocessing may include hydrocracking or both hydrotreating and hydrocracking. Furthermore, the process may comprise cooling the second hydrocracked effluent 132 to a temperature less than or equal to 250 degrees Celsius (° C.) to produce a cooled effluent 142.

The systems and processes of the present disclosure may reduce or prevent precipitation of heavy polynuclear aromatics and the fouling of components of the hydrocracking system. The precipitation of heavy polynuclear aromatics may be reduced or prevented by increasing the solubility of heavy polynuclear aromatics in the hydrocracked effluents. The solubility of heavy polynuclear aromatics in the hydrocracked effluents may be increased by reducing the saturation of aromatic compounds in one or more of the hydrocracking units (first hydrocracking unit 110, second hydrocracking unit 130, or both), which increases the concentration of aromatic compounds in the hydrocracked effluent that can improve the solubility of the heavy polynuclear aromatics in the hydrocracked effluents. This increase in the solubility of heavy polynuclear aromatics in the hydrocracked effluent may reduce or prevent the precipitation of heavy polynuclear aromatics during hydrocracking processes, particularly when the hydrocracked effluent is cooled after exiting the hydrocracking unit. This may lead to reduced sedimentation in the hydrocracking units or in downstream equipment, such as separation unit 120, heat transfer unit 140, or other downstream process equipment.

As used in the present disclosure, the term "reactor" refers to any vessel, container, or the like, in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors, such as fixed bed reactors, and fluidized bed reactors. One or more "reaction zones" may be disposed within a reactor. As used in the present disclosure, the term "reaction zone" refers to an area where a particular reaction takes place in a reactor. For example, a packed bed reactor with multiple catalyst beds may have multiple reaction zones, where each reaction zone is defined by the area of each catalyst bed.

As used in the present disclosure, a "separation unit" refers to any separation device that at least partially separates one or more chemicals in a mixture from one another. For example, a separation unit may selectively separate different chemical species from one another, forming one or more chemical fractions. Examples of separation units include, without limitation, distillation columns, fractionators, flash drums, knock-out drums, knock-out pots, centrifuges, filtration devices, traps, scrubbers, expansion devices, membranes, solvent extraction devices, high-pressure separators, low-pressure separators, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided or separated into two or more process streams of desired composition.

As used in the present disclosure, passing a stream or effluent from one unit "directly" to another unit may refer to passing the stream or effluent from the first unit to the second unit without passing the stream or effluent through an intervening reaction system or separation system that substantially changes the composition of the stream or effluent. Heat transfer devices, such as heat exchangers, preheaters, coolers, condensers, or other heat transfer equipment, and pressure devices, such as pumps, pressure regulators, compressors, or other pressure devices, are not considered to be intervening systems that change the composition of a stream or effluent. Combining two streams or effluents together also is not considered to comprise an intervening system that changes the composition of one or both of the streams or effluents being combined.

As used in the present disclosure, the term "final boiling point" or "FBP" of a composition refers to the temperature at which the greatest boiling temperature constituents of the composition transition from the liquid phase to the vapor phase.

As used in the present disclosure, the term "effluent" refers to a stream that is passed out of a reactor, a reaction zone, or a separation unit following a particular reaction or separation. Generally, an effluent has a different composition than the stream that entered the separation unit, reactor, or reaction zone. It should be understood that when an effluent is passed to another system unit, only a portion of that system stream may be passed. For example, a slip stream may carry some of the effluent away, meaning that only a portion of the effluent may enter the downstream system unit. The term "reaction effluent" may more particularly be used to refer to a stream that is passed out of a reactor or reaction zone.

As used in the present disclosure, the term "catalyst" refers to any substance which increases the rate of a specific chemical reaction. Catalysts described in the present disclosure may be utilized to promote various reactions, such as hydrotreating reactions, hydrocracking reactions, or both. The term "hydrotreating" refers to treatments of hydrocarbon streams through contact with hydrogen in the presence of one or more hydrotreating catalysts to remove contaminants, such as metal compounds, sulfur-containing hydrocarbons, and nitrogen-containing hydrocarbons, or otherwise condition or upgrade the hydrocarbon streams for further processing. The term "hydrocracking" refers to the cracking of hydrocarbons conducted in the presence of hydrogen. The term "cracking" refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. Some catalysts may have multiple forms of catalytic activity, and calling a catalyst by one particular function does not render that catalyst incapable of being catalytically active for other functionality.

As used in the present disclosure, the term "polynuclear aromatic hydrocarbons" refers to compounds containing less than seven fused hydrocarbon rings. As used in the present disclosure, the term "fused" refers to a hydrocarbon ring comprising two or more carbon atoms in the hydrocarbon ring that are shared with an adjacent hydrocarbon ring, rather than being coupled to the adjacent hydrocarbon ring by an alkyl group, commonly referred to as a carbon bridge. Compounds comprising fused hydrocarbon rings may also be referred to as condensed aromatics and compounds comprising hydrocarbon rings coupled by a carbon bridge may also be referred to as uncondensed aromatics. For example, naphthalene is a polynuclear aromatic hydrocarbon having two fused hydrocarbon rings compared to biphenyl, which has two hydrocarbon rings coupled by an alkyl group and is not a polynuclear aromatic hydrocarbon.

As used in the present disclosure, the term "heavy polynuclear aromatics" refers to fused polycyclic aromatic compounds having seven or more fused hydrocarbon rings and double bond equivalence (DBE) values of 19 and above. As used in the present disclosure, the term "double bond equivalence" refers to the sum of the number of double bonds and the number of hydrocarbon rings of a compound. For example, coronene, which has 7 hydrocarbon rings and 12 double bonds has a double bond equivalence of 19. Examples of heavy polynuclear aromatics include coronenes, benzocoronenes, dibenzocoronenes, and ovalenes. The aromatic structures of heavy polynuclear aromatics may include attached alkyl groups and naphthenic rings.

It should be understood that the reactions promoted by catalysts as described in the present disclosure may remove a chemical constituent, such as only a portion of a chemical constituent, from a process stream or may react all or only a portion of reactants in a reactor feed. For example, the systems and processes of the present disclosure may comprise a catalyst in an amount sufficient to promote a reaction that removes a portion of the nitrogen and sulfur present in a process stream. It should be understood that, throughout the present disclosure, a particular catalyst may not be limited in functionality to the removal, conversion, or cracking of a particular chemical constituent or moiety when it is referred to as having a particular functionality. For example, a catalyst identified in the present disclosure may provide hydrotreating functionality, hydrocracking functionality, or both.

It should further be understood that streams may be named for the components of the stream, and the component for which the stream is named may be the major component of the stream (such as comprising from 50 wt. %, from 70 wt. %, from 90 wt. %, from 95 wt. %, from 99 wt. %, from 99.5 wt. %, or from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "hydrogen stream" passing to a first system component or from a first system component to a second system component should be understood to equivalently disclose "hydrogen" passing to the first system component or passing from a first system component to a second system component.

Referring again to FIG. 1, a two-stage recycle hydrocracking system 100 of the present disclosure for upgrading or converting a hydrocarbon feed 102 through hydrocracking is schematically depicted. The system 100 may comprise a first hydrocracking unit 110, a separation unit 120 downstream of the first hydrocracking unit 110, a second hydrocracking unit 130 downstream of the separation unit 120, and a heat transfer unit 140 downstream of the second hydrocracking unit 130.

The hydrocarbon feed 102 may include one or more oil sources, such as vacuum gas oils, demetallized oil (DMO), deasphalted oil (DAO), coker gas oils, cycle oils, visbreaker oils, or combinations of these. The hydrocarbon feed 102 may comprise a raw oil source, such as crude oil that has not been previously processed, an oil source that has undergone some degree of processing prior to being introduced to the two-stage recycle hydrocracking system 100 as the hydrocarbon feed 102, or both. The hydrocarbon feed 102 may have a density of from 0.8500 grams per milliliter (g/mL) to 0.9900 g/mL, a hydrogen content of from 8 wt. % to 15 wt. % based on the total weight of the hydrocarbon feed 102, a sulfur content of from 0.25 wt. % to 5.00 wt. % based on the total weight of the hydrocarbon feed 102, a nitrogen content of from 500 ppmw to 3000 ppmw, and a boiling point range from 200° C. to 1000° C. One example of a hydrocarbon feed 102 suitable for introducing to the two-stage recycle hydrocracking system 100 is provided below in Table 1. The example hydrocarbon feed is a blend of a vacuum gas oil and a demetallized oil that was derived from a vacuum residue through a solvent deasphalting process using a paraffinic solvent, although it is understood that the hydrocarbon feed 102 may not be limited to this particular material.

TABLE 1

| Vacuum Gas Oil/Demetallized Oil Blend | | | |
|---|---|---|---|
| Analysis | Units | Value | Test Method |
| Density | g/mL | 0.9124 | ASTM D287 |
| Hydrogen Content | wt. % | 12.15 | ASTM D5292 |
| Sulfur Content | wt. % | 2.100 | ASTM D5453 |
| Nitrogen Content | ppmw | 815.0 | ASTM D4629 |
| Boiling Point Distribution | | | |
| Initial Boiling Point (IBP) | ° C. | 216 | ASTM D7169 |
| 10% Boiling Point (BP) | ° C. | 344 | ASTM D7169 |
| 30% BP | ° C. | 409 | ASTM D7169 |
| 50% BP | ° C. | 449 | ASTM D7169 |
| 70% BP | ° C. | 495 | ASTM D7169 |
| 90% BP | ° C. | 580 | ASTM D7169 |
| 95% BP | ° C. | 635 | ASTM D7169 |
| Final Boiling Point (FBP) | ° C. | 730 | ASTM D7169 |

The hydrocarbon feed 102 may be introduced directly to the first-stage unit 110 or may be combined with hydrogen upstream of the first hydrocracking unit 110. The hydrogen may comprise a hydrogen feed 104 from an external hydrogen source (not depicted), a recycle hydrogen stream 122*a* recovered from the separation unit 120, or both. The hydrogen may be introduced directly to the first hydrocracking unit 110 or combined with the hydrocarbon feed 102 upstream of the first hydrocracking unit 110.

The first hydrocracking unit 110 may be operable to contact the hydrocarbon feed 102 with the hydrogen in the presence of at least a first hydrocracking catalyst at reaction conditions sufficient to cause at least a portion of the hydrocarbons in the hydrocarbon feed 102 to undergo a hydrotreating reaction, a hydrocracking reaction, or both, to produce a first hydrocracked effluent 112. The first hydrocracking unit 110 may be any type of reactor operable to contact the hydrocarbon feed 102 with the hydrogen in the presence of the first hydrocracking catalyst at reaction conditions sufficient to cause at least a portion of the hydrocarbons in the hydrocarbon feed 102 to undergo a hydrotreating reaction, a hydrocracking reaction, or both, to produce the first hydrocracked effluent 112. Suitable reactors may include fixed bed reactors, moving bed reactors, fluidized bed reactors, plug flow reactors, or combinations of reactors, such as two or more fixed bed reactors arranged in series. For example, the first hydrocracking unit 110 may comprise one or more fixed bed reactors, which may be operated in downflow, upflow, or horizontal flow configurations.

The first hydrocracking catalyst in the first hydrocracking unit 110 may include one or more solid particulate catalysts capable of promoting or increasing the reaction rate of hydrotreating reactions, hydrocracking reactions, or both, of hydrocarbons in contact with hydrogen. Suitable catalysts may comprise amorphous alumina catalysts, amorphous silica-alumina catalysts, titania catalysts, zeolite catalysts, or combinations of these. Suitable zeolite catalysts may comprise Y-type zeolites, REY-type zeolites, USY-type zeolites, RE-USY-type zeolites, MFI-type zeolites, Beta zeolites, mordenite zeolites, or combinations of these. Suitable catalysts may further comprise one or more active phase materials, such as one or more metals from Groups 6-10 of the International Union of Pure and Applied Chemistry Periodic Table of the Elements (IUPAC periodic table). Suitable active phase materials may comprise nickel, tungsten, molybdenum, cobalt, titanium, zirconium, or combinations of these. The one or more active phase materials may be supported on the catalyst or embedded within the catalyst. For example, the first hydrocracking catalyst in the first hydrocracking unit 110 may comprise nickel and molybdenum supported on an amorphous silica-alumina catalyst. The first hydrocracking catalyst may be selected in order to preferentially promote or increase the reaction rate of hydrotreating reactions as opposed to hydrocracking reactions and, in particular, the removal of nitrogen-containing hydrocarbons and sulfur-containing hydrocarbons from the hydrocarbon feed 102. When such catalysts are used in the first hydrocracking unit 110, catalysts that are not tolerant to such impurities, such as those comprising significant amounts of zeolite catalysts, may be used in the second hydrocracking unit 130.

As previously described, contact of the hydrocarbon feed 102 with the hydrogen in the presence of the first hydrocracking catalyst may cause at least a portion of the hydrocarbons in the hydrocarbon feed 102 to undergo a hydrotreating reaction, a hydrocracking reaction, or both, to produce a first hydrocracked effluent 112. Accordingly, the first hydrocracked effluent 112 may have a concentration of one or more sulfur-containing hydrocarbons, nitrogen-containing hydrocarbons that is less than a concentration of these compounds in the hydrocarbon feed 102 by at least 1 percent (%), such as by at least 5%, at least 10%, at least 25%, at least 50%, at least 75%, at least 95% or at least 99%. The nitrogen-containing hydrocarbons may be converted to hydrocarbons and nitrogen-containing gases, such as ammonia ($NH_4$), and the sulfur-containing hydrocarbons may be converted to hydrocarbons and sulfur-containing gases, such as hydrogen sulfide ($H_2S$). The sulfur-containing gases and nitrogen-containing gases may be removed from the two-stage recycle hydrocracking system 100 downstream by the separation unit 120. The first hydrocracked effluent 112 may have a concentration of hydrocarbons having an atmospheric boiling point less than or equal to 370° C. that is less than a concentration of these hydrocarbons in the hydrocarbon feed 102 by at least 1%, such as by at least 5%, at least 10%, at least 25%, at least 50%, at least 75%, at least 95% or at least 99%.

The first hydrocracked effluent 112 may be passed directly from first hydrocracking unit 110 to the separation unit 120 without passing through any intervening reactors or separation units. The separation unit 120 may be operable to separate the first hydrocracked effluent 112 to produce at least a first separated effluent 122, a second separated effluent 124, a third separated effluent 126, and a fourth separated effluent 128. The separation unit 120 may comprise one or more separation units, which, collectively, may be operable to separate the first hydrocracked effluent 112 to produce at least a first separated effluent 122, a second separated effluent 124, a third separated effluent 126, and a fourth separated effluent 128.

The first separated effluent 122 may comprise compounds having an atmospheric boiling point less than or equal to 36° C., such as hydrogen, methane, hydrogen sulfide, ammonia, and other light gases. As used in the present disclosure, the term "light gases" refers to gases in the first hydrocracked effluent 112 that are in gaseous form at ambient temperature and pressure. The first separated effluent 122 may include at least 95%, at least 98%, or at least 99% by weight of the constituents from the first hydrocracked effluent 112 having atmospheric boiling points less than or equal to 36° C. The second separated effluent 124 may comprise compounds of the first hydrocracked effluent 112 having an atmospheric boiling point of from 36° C. to 180° C. The second separated effluent 124 may include at least 95%, at least 98%, or even at least 99% of the constituents of the first hydrocracked effluent 112 having atmospheric boiling points of from 36° C. to 180° C. The third separated effluent 126 may comprise compounds of the first hydrocracked effluent 112 having an atmospheric boiling point of from 180° C. to 370° C. The third separated effluent 126 may include at least 95%, at least 98%, or even at least 99% of the constituents of the first hydrocracked effluent 112 having atmospheric boiling points of from 180° C. to 370° C. Additionally, the third separated effluent 126 may have a cetane index of from 46 to 70 as determined by ASTM D976. A cetane index less than 46 may result in the third separated effluent 126 being unsuitable for commercial use without further processing. The second separated effluent 124 and the third separated effluent 126 may both be passed out of the two-stage recycle hydrocracking system 100. The fourth separated effluent 128 may comprise compounds of the first hydrocracked effluent 112 having an atmospheric boiling point greater than or equal to 370° C. The fourth separated effluent 128 may include at least 95%, at least 98%, or even at least 99% of the constituents of the first hydrocracked effluent 112 having atmospheric boiling points greater than or equal to 370° C.

The first separated effluent 122 may be passed to a gas treatment plant (not shown) for further processing, such as removal of hydrogen sulfide and ammonia, and separation and purification of hydrogen. Hydrogen recovered from the first separated effluent 122 may be recycled back to the first hydrocracking unit 110 as a recycle hydrogen stream **122*a*, the second hydrocracking unit 130 as a recycle hydrogen stream 122*b*, or both. The second separated effluent 124 and the third separated effluent 126 may both be passed out of the two-stage recycle hydrocracking system 100**.

All or at least a first portion of the fourth separated effluent **128*a* may be passed to the second hydrocracking unit 130, which may be disposed downstream of the separation unit 120. In embodiments, one or more of the first separated effluent 122, the second separated effluent 124, the third separated effluent 126, or combinations of these are not passed to the second hydrocracking unit 130. The fourth separated effluent 128*a* may be passed directly from the separation system 120 to the second hydrocracking unit 130 without passing through any intervening reactors or separators. The hydrogen may comprise a hydrogen feed from an external hydrogen source (not depicted), the recycle hydrogen stream 122*a* recovered from the separation unit 120, or both. The hydrogen may be introduced directly to the second hydrocracking unit 130 or combined with the fourth separated effluent 128*a* upstream of the second hydrocracking unit 130**.

The second hydrocracking unit 130 may be operable to contact the fourth separated effluent **128*a* with the hydrogen in the presence of at least a second hydrocracking catalyst at reaction conditions sufficient to cause at least a portion of the hydrocarbons in the fourth separated effluent 128*a* to undergo a hydrotreating reaction, a hydrocracking reaction, or both, to produce a second hydrocracked effluent 132. The second hydrocracking unit 130 may be any type of reactor operable to contact the fourth separated effluent 128*a* with the hydrogen in the presence of the second hydrocracking catalyst at reaction conditions sufficient to cause at least a portion of the hydrocarbons in the fourth separated effluent 128***a* to undergo a hydrotreating reaction, a hydrocracking reaction, or both, to produce the second hydrocracked effluent 132. Suitable reactors may comprise fixed bed reactors, moving bed reactors, fluidized bed reactors, plug flow reactors, or combinations of reactors, such as two or more fixed bed reactors arranged in series. For example, the second hydrocracking unit 130 may comprise one or more fixed bed reactors, which may be operated in downflow, upflow, or horizontal flow configurations.

The second hydrocracking catalyst in the second hydrocracking unit 130 may include one or more solid particulate catalysts capable of promoting or increasing the reaction rate of hydrotreating reactions, hydrocracking reactions, or both, of hydrocarbons in contact with hydrogen. Suitable catalysts may comprise amorphous alumina catalysts, amorphous silica-alumina catalysts, titania catalysts, zeolite catalysts, or combinations of these. Suitable zeolite catalysts may comprise Y-type zeolites, REY-type zeolites, USY-type zeolites, RE-USY-type zeolites, MFI-type zeolites, Beta zeolites, mordenite zeolites, or combinations of these. Suitable catalysts may further comprise one or more active phase materials, such as one or more metals from Groups 6-10 of the International Union of Pure and Applied Chemistry Periodic Table of the Elements (IUPAC periodic table). Suitable active phase materials may comprise nickel, tungsten, molybdenum, cobalt, titanium, zirconium, or combinations of these. The one or more active phase materials may be supported on the catalyst or embedded within the catalyst. For example, the second hydrocracking catalyst in the second hydrocracking unit 130 may comprise a USY-type zeolite comprising titanium and zirconium within the zeolite framework.

The first hydrocracking catalyst and the second hydrocracking catalyst may comprise the same or different catalysts. For example, both the first hydrocracking catalyst and the second hydrocracking catalyst may comprise nickel and molybdenum supported on an amorphous silica-alumina catalyst, or the first hydrocracking catalyst may comprise nickel and molybdenum supported on an amorphous silica-alumina catalyst and the second hydrocracking catalyst may comprise a USY-type zeolite comprising titanium and zirconium within the zeolite framework. As described previously, the first hydrocracking catalyst may be selected in order to preferentially promote or increase the reaction rate of hydrotreating reactions as opposed to hydrocracking reactions and, in particular, the removal of nitrogen-containing hydrocarbons and sulfur-containing hydrocarbons from the hydrocarbon feed 102. This may allow the second hydrocracking catalyst to comprise catalysts that are not as tolerant to such impurities, such as catalysts comprising significant amounts of zeolite catalysts. When the first hydrocracking catalyst is not selected in order to preferentially promote or increase the reaction rate of hydrotreating reactions, zeolite catalysts may not be suitable for use as the second hydrocracking catalyst as they will be rapidly deactivated.

As previously described, contact of the fourth separated effluent 128*a* with the hydrogen in the presence of the second hydrocracking catalyst may cause at least a portion of the hydrocarbons in the fourth separated effluent 128*a* to undergo a hydrotreating reaction, a hydrocracking reaction, or both, to produce a second hydrocracked effluent 132. The second hydrocracked effluent 132 may have a concentration of one or more sulfur-containing hydrocarbons and nitrogen-containing hydrocarbons that is less than a concentration of these compounds in the fourth separated effluent 128*a* by at least 1%, such as by at least 5%, at least 10%, at least 25%, at least 50%, at least 75%, at least 95% or at least 99%. The nitrogen-containing hydrocarbons may be converted to hydrocarbons and nitrogen-containing gases, such as ammonia ($NH_4$), and the sulfur-containing hydrocarbons may be converted to hydrocarbons and sulfur-containing gases, such as hydrogen sulfide ($H_2S$). The sulfur-containing gases and nitrogen-containing gases may be removed from the two-stage recycle hydrocracking system 100 downstream by the separation unit 120. The second hydrocracked effluent 132 may have a concentration of hydrocarbons having an atmospheric boiling point less than or equal to 370° C. that is less than a concentration of these hydrocarbons in the fourth separated effluent 128*a* by at least 1%, such as by at least 5%, at least 10%, at least 25%, at least 50%, at least 75%, at least 95% or at least 99%.

Additionally, as previously described, the upgrading or conversion of the fourth separated effluent 128*a* in the second hydrocracking unit 130 may result in the formation of heavy polynuclear aromatics. Accordingly, the second hydrocracked effluent 132 may have a concentration of heavy polynuclear aromatics greater than the fourth separated effluent 128*a*. In particular, the second hydrocracked effluent 132 may have a concentration of heavy polynuclear aromatics of from 50 ppmw to 5000 ppmw based on the total weight of the second hydrocracked effluent 132. For example, the second hydrocracked effluent 132 may have a concentration of heavy polynuclear aromatics of from 50 ppmw to 4000 ppmw, from 50 ppmw to 3000 ppmw, from 50 ppmw to 2000 ppmw, from 50 ppmw to 1000 ppmw, from 1000 ppmw to 5000 ppmw, from 1000 ppmw to 4000 ppmw, from 1000 ppmw to 3000 ppmw, from 1000 ppmw to 2000 ppmw, from 2000 ppmw to 5000 ppmw, from 2000 ppmw to 4000 ppmw, from 2000 ppmw to 3000 ppmw, from 3000 ppmw to 5000 ppmw, from 3000 ppmw to 4000 ppmw, or from 4000 ppmw to 5000 ppmw based on the total weight of the second hydrocracked effluent 132.

The second hydrocracked effluent 132 may be passed from the second hydrocracking unit 130 to the heat transfer unit 140, which may be disposed downstream of the second hydrocracking unit 130. The heat transfer unit 140 may be operable to reduce the temperature of the second hydrocracked effluent 132 to produce a cooled effluent 142, which is passed back to the separation unit 120. In particular, the heat transfer unit 140 may be operable to reduce the temperature of the second hydrocracked effluent to less than or equal to 250° C. For example, the heat transfer unit 140 may be operable to reduce the temperature of the second hydrocracked effluent to less than or equal to 225° C., less than or equal to 200° C., less than or equal to 175° C., less than or equal to 150° C., less than or equal to 125° C., less than or equal to 100° C., less than or equal to 75° C., or less than or equal to 40° C. The heat transfer unit 140 may be any type of unit suitable to reduce the temperature of product streams of a reactor system. Accordingly, the heat transfer unit 140 may comprise one or more of air coolers, water coolers, heat exchangers such as shell and tube heat exchangers, or combinations of these. After cooling, the cooled effluent 142 pay be passed back (recycled) to the separation unit 120. The cooled effluent 142 may be passed directly to the separation unit 120 from the heat transfer unit 140, or may be mixed with the first hydrocracked effluent 112 upstream of the separation unit 120.

Optionally, a second portion of the fourth separated effluent 128*b* may be passed back to the first hydrocracking unit 110. The second portion of the fourth separated effluent

128*b* passed back to the first hydrocracking unit 110 may be combined with the hydrocarbon feed 102 upstream of the first hydrocracking unit 110 or may be passed directly and independently to the first hydrocracking unit 110. Passing the second portion of the fourth separated effluent 128*b* back to the first hydrocracking unit 110 may increase the yield of olefins and aromatic compounds from the two-stage recycle hydrocracking system 100 by further converting larger hydrocarbons remaining in the second portion of the fourth separated effluent 128*b* to smaller paraffinic hydrocarbons more suitable for commercial use.

As described previously, hydrocarbon feeds for hydrocracking processes, such as hydrocarbon feed 102, may include polynuclear aromatic hydrocarbons as one of the constituents. During the upgrading or conversion of the hydrocarbon feed 102 in the first hydrocracking unit 110 and the fourth separated effluent 128*a* in the second hydrocracking unit 130, the polynuclear aromatic hydrocarbons often react under the hydrocracking reaction conditions to form heavy polynuclear aromatics, which may then pass out of the first hydrocracking unit 110 and the second hydrocracking unit 130 in the first hydrocracked effluent 112 and the second hydrocracked effluent 132, respectively. Aromatic compounds in the first hydrocracked effluent 112 and the second hydrocracked effluent 132 may stabilize and solubilize these heavy polynuclear aromatics; however, during the upgrading or conversion of the hydrocarbon feed 102 in the first hydrocracking unit 110 and the fourth separated effluent 128*a* in the second hydrocracking unit 130, the concentration of aromatic compounds may be reduced through hydrogenation and saturation of the aromatic rings under the operating conditions of the hydrocracking units. Moreover, as the operating conditions of the first hydrocracking unit 110 and the second hydrocracking unit 103 increase in severity, the concentration of heavy polynuclear aromatics in the first hydrocracked effluent 112 and the second hydrocracked effluent 132 increases while the concentration of aromatics in the first hydrocracked effluent 112 and the second hydrocracked effluent 132 decreases. Accordingly, in order to reduce or prevent the precipitation and buildup of heavy polynuclear aromatics, the severity of the operating conditions of the first hydrocracking unit 110, the second hydrocracking unit 130, or both, may be reduced to decrease formation of heavy polynuclear aromatics, decrease saturation of aromatic compounds, or both. Reducing saturation of aromatic compounds in the first hydrocracking unit 110, the second hydrocracking unit 130, or both, may result in greater concentrations of aromatic compounds in the first hydrocracked effluent 112, the second hydrocracked effluent 132, or both, which may increase the solubility of the heavy polynuclear aromatics in the first hydrocracked effluent 112, the second hydrocracked effluent 132, or both, and reduce or prevent precipitation and sedimentation in the second hydrocracking unit 130, heat transfer unit 140, or other downstream processing equipment.

Referring again to FIG. 1, a process for reducing or preventing the precipitation of heavy polynuclear aromatics during hydrocracking may comprise introducing the hydrocarbon feed 102 and hydrogen to the first hydrocracking unit 110, which is operable to contact the hydrocarbon feed 102 with the hydrogen in the presence of at least a first hydrocracking catalyst to produce a first hydrocracked effluent 112. The first hydrocracked effluent 112 may be passed to the separation unit 120, which is operable to separate the first hydrocracked effluent 112 to produce at least the first separated effluent 122, the second separated effluent 124, the third separated effluent 126, and the fourth separated effluent 128.

The process may further comprise maintaining the first hydrocracking unit 110 at operating conditions such that the third separator effluent 126 has a total concentration of aromatic compounds of from 1 wt. % to 30 wt. % based on the total weight of the third separated effluent 126. For example, the process may comprise maintaining the first hydrocracking unit 110 at operating conditions such that the third separator effluent 126 has a total concentration of aromatic compounds of from 1 wt. % to 25 wt. %, from 1 wt. % to 20 wt. %, from 1 wt. % to 15 wt. %, from 1 wt. % to 10 wt. %, from 1 wt. % to 5 wt. %, from 5 wt. % to 30 wt. %, from 5 wt. % to 25 wt. %, from 5 wt. % to 20 wt. %, from 5 wt. % to 15 wt. %, from 5 wt. % to 10 wt. %, from 10 wt. % to 30 wt. %, from 10 wt. % to 25 wt. %, from 10 wt. % to 20 wt. %, from 10 wt. % to 15 wt. %, from 15 wt. % to 30 wt. %, from 15 wt. % to 25 wt. %, from 15 wt. % to 20 wt. %, from 20 wt. % to 30 wt. %, from 20 wt. % to 25 wt. %, or from 25 wt. % to 30 wt. % based on the total weight of the third separated effluent 126. Without being bound by any particular theory, it is believed that the concentration of aromatic compounds in the third separator effluent 126 may be indicative of the concentration of aromatic compounds in the first hydrocracked effluent 112, the second hydrocracked effluent 132, or both. When the concentration of aromatic compounds in the third separator effluent 126 is less than 1 wt. %, the concentration of aromatic compounds in the first hydrocracked effluent 112, the second hydrocracked effluent 132, or both, may not be sufficient to maintain the solubility of heavy polynuclear aromatics in the first hydrocracked effluent 112, the second hydrocracked effluent 132, or both.

The operating conditions of the first hydrocracking unit 110, which are maintained such that the third separator effluent 126 has a total concentration of aromatic compounds of from 1 wt. % to 30 wt. % based on the total weight of the third separated effluent 126, may comprise operating temperature, operating pressure, liquid hourly space velocity (LHSV), hydrogen feed rate, or combinations of these. The first hydrocracking unit 110 may be operated at a temperature of from 300° C. to 450° C., such as from 300° C. to 425° C., from 300° C. to 400° C., from 300° C. to 375° C., from 300° C. to 350° C., from 300° C. to 325° C., from 325° C. to 450° C., from 325° C. to 425° C., from 325° C. to 400° C., from 325° C. to 375° C., from 325° C. to 350° C., from 350° C. to 450° C., from 350° C. to 425° C., from 350° C. to 400° C., from 350° C. to 375° C., from 375° C. to 450° C., from 375° C. to 425° C., from 375° C. to 400° C., from 400° C. to 450° C., from 400° C. to 425° C., or from 425° C. to 450° C. The first hydrocracking unit 110 may be operated at a pressure of from 5000 kilopascals (kPa) to 20000 kPa, such as from 5000 kPa to 17500 kPa, from 5000 kPa to 15000 kPa, from 5000 kPa to 12500 kPa, from 5000 kPa to 10000 kPa, from 5000 kPa to 7500 kPa, from 75 kPa to 20000 kPa, from 7500 kPa to 17500 kPa, from 7500 kPa to 15000 kPa, from 7500 kPa to 12500 kPa, from 7500 kPa to 10000 kPa, from 10000 kPa to 20000 kPa, from 10000 kPa to 17500 kPa, from 10000 kPa to 15000 kPa, from 10000 kPa to 12500 kPa, from 12500 kPa to 20000 kPa, from 12500 kPa to 17500 kPa, from 12500 kPa to 15000 kPa, from 15000 kPa to 20000 kPa, from 15000 kPa to 17500 kPa, or from 17500 kPa to 20000 kPa. The first hydrocracking unit 110 may be operated at a liquid hourly space velocity of from 0.1 per hour ($hr^{-1}$) to 4 $hr^{-1}$, such as from 0.1 $hr^{-1}$ to 3 $hr^{-1}$, from 0.1 $hr^{-1}$ to 2 $hr^{-1}$, from 0.1 $hr^{-1}$ to 1 $hr^{-1}$, from 1 $hr^{-1}$ to 4 $hr^{-1}$, from 1 $hr^{-1}$ to 3 $hr^{-1}$, from 1 $hr^{-1}$ to 2 $hr^{-1}$, from 2 $hr^{-1}$ to 4 $hr^{-1}$, from 2 $hr^{-1}$ to 3 $hr^{-1}$, or from 3 $hr^{-1}$ to 4 $hr^{-1}$. The first hydrocracking unit 110 may be operated at a hydrogen feed rate of from 1000 standard liters of hydrogen per liter of hydrocarbon feed (SLt/Lt) to 2500 SLt/Lt, such as from 1000 SLt/Lt to 2200 SLt/Lt, from 1000 SLt/Lt to 1900 SLt/Lt, from 1000 SLt/Lt to 1600 SLt/Lt, from 1000 SLt/Lt to 1300 SLt/Lt, from 1300 SLt/Lt to 2500 SLt/Lt, from 1300 SLt/Lt to 2200 SLt/Lt, from 1300 SLt/Lt to 1900 SLt/Lt, from 1300 SLt/Lt to 1600 SLt/Lt, from 1600 SLt/Lt to 2500 SLt/Lt, from 1600 SLt/Lt to 2200 SLt/Lt, from 1600 SLt/Lt to 1900 SLt/Lt, from 1900 SLt/Lt to 2500 SLt/Lt, from 1900 SLt/Lt to 2200 SLt/Lt, or from 2200 SLt/Lt to 2500 SLt/Lt.

The process may further comprise passing at least a portion of the fourth separated effluent 128*a* and hydrogen to the second hydrocracking unit 130, which is operable to contact the fourth separated effluent 128*a* and the hydrogen in the presence of at least a second hydrocracking catalyst to produce a second hydrocracked effluent 132. As described previously, the upgrading or conversion of the hydrocarbon feed 102 in the first hydrocracking unit 110 and the fourth separated effluent 128*a* in the second hydrocracking unit 130 may result in in the formation of heavy polynuclear aromatics, which may remain soluble given a sufficient concentration of aromatic compounds in the effluent.

Accordingly, the process may further comprise maintaining the second hydrocracking unit 130 at operating conditions such that the second hydrocracking effluent 132 has a total concentration of aromatic compounds of from 1 wt. % to 20 wt. % based on the total weight of the second hydrocracked effluent 132. For example, the process may comprise maintaining the second hydrocracking unit 130 at operating conditions such that the second hydrocracking effluent 132 has a total concentration of aromatic compounds of from 1 wt. % to 15 wt. %, from 1 wt. % to 10 wt. %, from 10 wt. % to 20 wt. %, from 10 wt. % to 15 wt. %, or from 15 wt. % to 20 wt. % based on the total weight of the second hydrocracked effluent 132. Without being bound by any particular theory, it is believed that a total concentration of aromatic compounds less than 1 wt. % may not be sufficient to maintain the solubility of heavy polynuclear aromatics in the second hydrocracked effluent and a total concentration of aromatic compounds greater than 20 wt. % may indicate that the conversion rate of the hydrocarbon feed 102 has been unnecessarily reduced. However, the total concentration of aromatic compounds sufficient to maintain the solubility of heavy polynuclear aromatics in the second hydrocracked effluent may depend on the concentration of heavy polynuclear aromatics in the second hydrocracked effluent. For example, as the concentration of heavy polynuclear aromatics in the second hydrocracked effluent increases, the total concentration of aromatic compounds may also increase in order to maintain the solubility of heavy polynuclear aromatics in the second hydrocracked effluent.

The operating conditions of the second hydrocracking unit 130, which are maintained such that the second hydrocracking effluent 132 has a total concentration of aromatic compounds of from 1 to 20 wt. % based on the total weight of the second hydrocracked effluent 132, may comprise operating temperature, operating pressure, liquid hourly space velocity, hydrogen feed rate, or combinations of these. The second hydrocracking unit 130 may be operated at a temperature of from 300° C. to 450° C., such as from 300° C. to 425° C., from 300° C. to 400° C., from 300° C. to 375° C., from 300° C. to 350° C., from 300° C. to 325° C., from 325° C. to 450° C., from 325° C. to 425° C., from 325° C. to 400° C., from 325° C. to 375° C., from 325° C. to 350° C., from 350° C. to 450° C., from 350° C. to 425° C., from 350° C. to 400° C., from 350° C. to 375° C., from 375° C. to 450° C., from 375° C. to 425° C., from 375° C. to 400° C., from 400° C. to 450° C., from 400° C. to 425° C., or from 425° C. to 450° C. The second hydrocracking unit 130 may be operated at a pressure of from 5000 kPa to 20000 kPa, such as from 5000 kPa to 17500 kPa, from 5000 kPa to 15000 kPa, from 5000 kPa to 12500 kPa, from 5000 kPa to 10000 kPa, from 5000 kPa to 7500 kPa, from 75 kPa to 20000 kPa, from 7500 kPa to 17500 kPa, from 7500 kPa to 15000 kPa, from 7500 kPa to 12500 kPa, from 7500 kPa to 10000 kPa, from 10000 kPa to 20000 kPa, from 10000 kPa to 17500 kPa, from 10000 kPa to 15000 kPa, from 10000 kPa to 12500 kPa, from 12500 kPa to 20000 kPa, from 12500 kPa to 17500 kPa, from 12500 kPa to 15000 kPa, from 15000 kPa to 20000 kPa, from 15000 kPa to 17500 kPa, or from 17500 kPa to 20000 kPa. The second hydrocracking unit 130 may be operated at a liquid hourly space velocity of from 0.1 $hr^{-1}$ to 4 $hr^{-1}$, such as from 0.1 $hr^{-1}$ to 3 $hr^{-1}$, from 0.1 $hr^{-1}$ to 2 $hr^{-1}$, from 0.1 $hr^{-1}$ to 1 $hr^{-1}$, from 1 $hr^{-1}$ to 4 $hr^{-1}$, from 1 $hr^{-1}$ to 3 $hr^{-1}$, from 1 $hr^{-1}$ to 2 $hr^{-1}$, from 2 $hr^{-1}$ to 4 $hr^{-1}$, from 2 $hr^{-1}$ to 3 $hr^{-1}$, or from 3 $hr^{-1}$ to 4 $hr^{-1}$. The second hydrocracking unit 130 may be operated at a hydrogen feed rate of from 1000 standard liters of hydrogen per liter of hydrocarbon feed (SLt/Lt) to 2500 SLt/Lt, such as from 1000 SLt/Lt to 2200 SLt/Lt, from 1000 SLt/Lt to 1900 SLt/Lt, from 1000 SLt/Lt to 1600 SLt/Lt, from 1000 SLt/Lt to 1300 SLt/Lt, from 1300 SLt/Lt to 2500 SLt/Lt, from 1300 SLt/Lt to 2200 SLt/Lt, from 1300 SLt/Lt to 1900 SLt/Lt, from 1300 SLt/Lt to 1600 SLt/Lt, from 1600 SLt/Lt to 2500 SLt/Lt, from 1600 SLt/Lt to 2200 SLt/Lt, from 1600 SLt/Lt to 1900 SLt/Lt, from 1900 SLt/Lt to 2500 SLt/Lt, from 1900 SLt/Lt to 2200 SLt/Lt, or from 2200 SLt/Lt to 2500 SLt/Lt.

The process may comprise reducing the severity of the hydrocracking of the hydrocarbon feed 102, reducing the severity of the hydrocracking of the fourth separated effluent 128*a*, or both, such that an aromatic concentration of the third separated effluent 126 is greater than or equal to 10 wt. % based on the total weight of the third separated effluent 126. As described previously, as the operating conditions of the first hydrocracking unit 110 and the second hydrocracking unit 103 increase in severity, the concentration of heavy polynuclear aromatics in the first hydrocracked effluent 112 and the second hydrocracked effluent 132 increases while the concentration of aromatic compounds in the first hydrocracked effluent 112 and the second hydrocracked effluent 132 decreases. To reduce or prevent the precipitation and buildup of heavy polynuclear aromatics, which may be achieved by decreasing the concentration of heavy polynuclear aromatics, increasing the concentration of aromatics, or both, the severity of the operating conditions of the first hydrocracking unit, the second hydrocracking unit, or both, may be reduced. Moreover, since the third separated effluent 126 may be measured to determine the concentration of aromatic compounds in the effluents of the two-stage recycle hydrocracking system 100, the severity of the first hydrocracking unit 110, the second hydrocracking unit 130, or both, may be reduced based on the total concentration of aromatic compounds in the third separated effluent 126. That is, the severity of the first hydrocracking unit 110, the second hydrocracking unit 130, or both, may be reduced such that the concentration of aromatic compounds in the third separated effluent 126 is sufficient to maintain the solubility of heavy polynuclear aromatics in the third separated effluent 126.

The process may comprise determining the cetane index, the concentration of aromatics, or both, of the third separated effluent 126. The process may include determining whether the cetane value of the third separated effluent 126 is in a range of from 46 to 70, whether the concentration of aromatic compounds in the third separated effluent 126 is in a range of from 1 wt. % to 30 wt. % based on the total weight of the third separated effluent 126, or both. The process may further comprise modifying one or more operating conditions, such as temperature, pressure, liquid hourly space velocity, hydrogen feed rate, or combinations of these, of the first hydrocracking unit 110, the second hydrocracking unit 130, or both, based on the determination. Modifying the one or more operating conditions may include increasing or decreasing one or more of the operating conditions to change the severity of the operating conditions. The process may include determining the concentration of heavy polynuclear aromatics, the concentration of aromatics, or both, of the second hydrocracked effluent 132. The process may include determining whether the concentration of heavy polynuclear aromatics in the second hydrocracked effluent 132 is in a range of from 50 ppmw to 5,000 ppmw based on the total weight of the second hydrocracked effluent 132, whether the concentration of aromatic compounds in the second hydrocracked effluent 132 is in a range of from 1 wt. % to 20 wt. % based on the total weight of the second hydrocracked effluent 132, or both. The process may further include modifying one or more operating conditions, such as temperature, pressure, liquid hourly space velocity, hydrogen feed ratio, or combinations of these, of the first hydrocracking unit 110, the second hydrocracking unit 130, or both, based on the determination.

EXAMPLES

The various aspects of systems and processes for upgrading or converting petroleum-based materials to petrochemical products through hydrocracking will be further clarified by the following examples. The examples are illustrative in nature and should not be understood to limit the subject matter of the present disclosure.

Comparative Example 1

In Comparative Example 1, a hydrocarbon feed was processed in a pilot-plant-sized hydrocracking system. The properties of the hydrocarbon feed were previously provided in Table 1. The first-stage was operated at a temperature of 405° C., a pressure of 12000 kPa, a liquid hourly space velocity of 0.375 $h^{-1}$, and a hydrogen feed rate of 1300 SLt/Lt. The catalyst used in the first-stage comprised nickel and tungsten supported on an amorphous silica catalyst. The second-stage was operated at a temperature of 367° C., a pressure of 120 kPa, a liquid hourly space velocity of 0.375 $h^{-1}$, and a hydrogen feed rate of 1300 SLt/Lt. The catalyst used in the second-stage comprised a USY-type zeolite comprising titanium and zirconium within the zeolite framework produced according to the methods described in U.S. Pat. No. 10,357,761. The effluent was collected from the hydrocracking unit and the properties and composition of the effluent were analyzed according to the methods shown in Table 2. These properties included the hydrogen sulfide concentration, the ammonia concentration, the methane concentration, the ethane concentration, the propane concentration, the butane concentration, the naphtha concentration, the kerosene concentration, the diesel concentration, and the concentration of unconverted hydrocarbon feed.

TABLE 2

| Property | Method |
|---|---|
| Carbon Content | ASTM D5291 |
| Hydrogen Content | ASTM D5292 |
| Sulfur Content | ASTM D5453 |
| Nitrogen Content | ASTM D4629 |
| SimDis (Boiling Point) | ASTM D7169 |

Table 3 provides the operating conditions for the hydrocracking process of Example 1 as well as the composition of the effluent recovered from the hydrocracking process of Example 1.

TABLE 3

| Operating Conditions | |
|---|---|
| First-Stage Temperature (° C.) | 405 |
| Second-Stage Temperature (° C.) | 367 |
| Overall LHSV ($h^{-1}$) | 0.375 |
| Overall Pressure (kPa) | 12000 |
| Hydrogen Feed Rate (SLt/Lt) | 1300 |
| Hydrogen Consumption (wt. %) | 2.69 |
| Composition (wt. %) | |
| Hydrogen Sulfide ($H_2S$) | 2.36 |
| Ammonia ($NH_3$) | 0.10 |
| Methane | 0.26 |
| Ethane | 0.38 |
| Propane | 1.45 |
| Butane | 4.24 |
| Naphtha | 41.70 |
| Kerosene | 17.50 |
| Diesel | 30.10 |
| Unconverted Hydrocarbon Feed | 4.60 |

The diesel fraction of the effluent, which corresponds to the third separated effluent of the present disclosure, was determined to have a cetane index of 63.9 and comprise a concentration of aromatic compounds of 9.5 wt. % based on the total weight of the diesel fraction. The unconverted fraction of the effluent, which corresponds to the second hydrocracked effluent of the present disclosure, was determined to comprise a concentration of coronenes (heavy polynuclear aromatics) of 3000 ppmw and a total concentration of aromatic compounds of 3.5 wt. % based on the total weight of the unconverted fraction. The entire effluent was determined to have a total concentration of aromatic compounds of 10.8 wt. % based on the total weight of the effluent. Without being bound by any particular theory, it is believed that the total concentration of aromatic compounds in the effluent would not be sufficient to maintain the concentration of heavy polynuclear aromatics in solution at temperatures less than 218° C. and, in particular, at the temperatures of air cooler outlets, which may be 45° C. or less. Accordingly, the process conditions of Comparative Example 1, in conjunction with the particular hydrocarbon feed, would not be sufficient to reduce or prevent fouling by the buildup of heavy polynuclear aromatics.

Example 2

In Example 2, the hydrocracking process of Comparative Example 1 was repeated with operating conditions of a lesser severity. In particular, the temperature of the first-stage was reduced to 395° C., the temperature of the second stage was reduced to 357° C., and the overall pressure of both stages was reduced to 11000 kPa. The effluent was collected from the hydrocracking unit and the properties and composition of the effluent were analyzed according to the methods shown in Table 2. The composition of the effluent is reported in Table 4.

TABLE 4

| Composition (wt. %) | |
|---|---|
| Hydrogen Sulfide ($H_2S$) | 2.36 |
| Ammonia ($NH_3$) | 0.10 |
| Methane | 0.13 |
| Ethane | 0.19 |
| Propane | 0.78 |
| Butane | 2.46 |
| Naphtha | 24.22 |
| Kerosene | 11.38 |
| Diesel | 27.98 |
| Unconverted Hydrocarbon Feed | 32.65 |

The diesel fraction of the resulting effluent, which corresponds to the third separated effluent of the present disclosure, was determined to have a slightly reduced cetane index of 60 and to comprise a greater concentration of aromatic compounds of 16.2 wt. % based on the total weight of the diesel fraction. Without being bound by any particular theory, it is believed that the increase in the concentration of aromatic compounds would be sufficient to maintain heavy polynuclear aromatics in solution during cooling while also maintaining a suitable cetane index of the diesel fraction.

Example 3

In Example 3, 7.2 grams of a sample comprising a concentration of heavy polynuclear aromatics of 3000 ppmw, which effectively simulates an effluent from the second hydrocracking unit described previously, was prepared. At room temperature, the heavy polynuclear aromatics were observed to be precipitating from solution and accumulating on the sample container. The sample was then mixed with 12.7 grams of an aromatic solvent having properties of which are provided in Table 5. After mixing, the heavy polynuclear aromatics were no longer visible as precipitates and any deposits that had accumulated on the surface of the container also returned to solution.

TABLE 5

| Composition (wt. %) | |
|---|---|
| Paraffins | 1 |
| Mono-Naphthenes | 0 |
| Di-Naphthenese | 0 |
| Mono-Aromatics | 74.6 |
| Naphtheno Mono-Aromatics | 3.1 |
| Di-Aromatics | 15.4 |
| Naptheno Di-Aromatics | 5.2 |
| Tri-Aromatics | 5.2 |

A first aspect of the present disclosure may comprise a two-stage recycle hydrocracking process comprising hydrocracking at least a portion of a hydrocarbon feed to produce a first hydrocracked effluent; separating the first hydrocracked effluent into at least a first separated effluent, a second separated effluent, a third separated effluent, and a fourth separated effluent; hydrocracking at least a portion of the fourth separated effluent to produce a second hydrocracked effluent; and cooling the second hydrocracked effluent to a temperature less than or equal to 250 degrees Celsius to produce a cooled effluent. The third separated effluent may have a cetane index of from 46 to 70 and a total concentration of aromatic compounds of from 1 weight percent to 30 weight percent based on the total weight of the third separated effluent, and the second hydrocracking effluent may have a concentration of heavy polynuclear aromatics of from 50 parts per million by weight to 5000 parts per million by weight and a total concentration of aromatic compounds of from 1 weight percent to 20 weight percent based on the total weight of the second hydrocracked effluent. The concentration of aromatic compounds of from 1 weight percent to 20 weight percent in the second hydrocracked effluent may maintain the solubility of the heavy polynuclear aromatics in the second hydrocracked effluent and reduce precipitation of the heavy polynuclear aromatics in the second hydrocracked effluent.

A second aspect of the present disclosure may comprise the first aspect, further comprising recycling at least a portion of the cooled effluent to the separation system.

A third aspect of the present disclosure may comprise either one of the first or second aspect, where hydrocracking at least a portion of the hydrocarbon feed comprises introducing the hydrocarbon feed to a first hydrocracking unit operable to contact the hydrocarbon feed with hydrogen in the presence of at least a first hydrocracking catalyst to produce the first hydrocracked effluent.

A fourth aspect of the present disclosure may comprise the third aspect, where the first hydrocracking catalyst comprises one or more metals from Groups 6-10 of the International Union of Pure and Applied Chemistry Periodic Table of the Elements supported on an amorphous silica-alumina catalyst.

A fifth aspect of the present disclosure may comprise either one of the third or fourth aspect, where the operating conditions of the first hydrocracking unit comprise one or more of: a temperature of from 300 degrees Celsius to 450 degrees Celsius; a pressure of from 5000 kilopascals to 20000 kilopascals; a liquid hourly space velocity of from 0.1 per hour to 4 per hour; or a hydrogen feed rate of from 1000 standard liters of hydrogen per liter of hydrocarbon feed to 2500 standard liters of hydrogen per liter of hydrocarbon feed.

A sixth aspect of the present disclosure may comprise any one of the first through fifth aspects, where separating the first hydrocracked effluent comprises passing the first hydrocracked effluent to a separation unit operable to separate the first hydrocracked effluent to produce at least the first separated effluent, the second separated effluent, the third separated effluent, and the fourth separated effluent.

A seventh aspect of the present disclosure may comprise any one of the first through sixth aspects, where hydrocracking at least a portion of the fourth separated effluent comprises passing the fourth separated effluent to a second hydrocracking unit operable to contact the fourth separated effluent with hydrogen in the presence of at least a second hydrocracking catalyst to produce the second hydrocracked effluent.

An eighth aspect of the present disclosure may comprise the seventh aspect, where the second hydrocracking catalyst comprises a USY-type zeolite.

A ninth aspect of the present disclosure may comprise either one of the seventh or eighth aspect, where the operating conditions of the first hydrocracking unit comprise one or more of: a temperature of from 300 degrees Celsius to 450 degrees Celsius; a pressure of from 5000 kilopascals to 20000 kilopascals; a liquid hourly space velocity of from 0.1 per hour to 4 per hour; or a hydrogen feed rate of from 1000 standard liters of hydrogen per liter of hydrocarbon feed to 2500 standard liters of hydrogen per liter of hydrocarbon feed.

A tenth aspect of the present disclosure may comprise any one of the first through ninth aspects, where cooling the second hydrocracked effluent comprises passing the second hydrocracked effluent to a heat transfer unit operable to reduce the temperature of the second hydrocracked effluent to produce the cooled effluent.

An eleventh aspect of the present disclosure may comprise any one of the first through tenth aspects, further comprising reducing the severity of the hydrocracking of the hydrocarbon feed, the hydrocracking of the fourth separated effluent, or both, such that an aromatic concentration of the third separated effluent is greater than or equal to 10 weight percent based on the total weight of the third separated effluent.

A twelfth aspect of the present disclosure may comprise a process for reducing or preventing the precipitation of heavy polynuclear aromatics during hydrocracking comprising introducing a hydrocarbon feed and hydrogen to a first hydrocracking unit operable to contact the hydrocarbon feed with the hydrogen in the presence of at least a first hydrocracking catalyst to produce a first hydrocracked effluent; passing the first hydrocracked effluent to a separation unit downstream of the first hydrocracking unit, the separation unit operable to separate the first hydrocracked effluent to produce at least a first separated effluent, a second separated effluent, a third separated effluent, and a fourth separated effluent; passing at least a portion of the fourth separated effluent and hydrogen to a second hydrocracking unit downstream of the separation system, the second hydrocracking unit operable to contact the fourth separated effluent and the hydrogen in the presence of at least a second hydrocracking catalyst to produce a second hydrocracked effluent; and maintaining the first hydrocracking unit, the second hydrocracking unit, or both at operating conditions to produce the third separated effluent having a cetane index of from 46 to 70 and a total concentration of aromatic compounds of from 1 weight percent to 30 weight percent based on the total weight of the third separated effluent and the second hydrocracking effluent having a concentration of heavy polynuclear aromatics of from 50 parts per million by weight to 5000 parts per million by weight and a total concentration of aromatic compounds of from 1 weight percent to 20 weight percent based on the total weight of the second hydrocracked effluent. The concentration of aromatic compounds of from 1 weight percent to 20 weight percent in the second hydrocracked effluent may maintain the solubility of the heavy polynuclear aromatics in the second hydrocracked effluent and reduce precipitation of the heavy polynuclear aromatics in the second hydrocracked effluent.

A thirteenth aspect of the present disclosure may comprise the twelfth aspect, where the first hydrocracking catalyst comprises one or more metals from Groups 6-10 of the International Union of Pure and Applied Chemistry Periodic Table of the Elements supported on an amorphous silica-alumina catalyst.

A fourteenth aspect of the present disclosure may comprise either one of the twelfth or thirteenth aspects, where the operating conditions of the first hydrocracking unit comprise one or more of: a temperature of from 300 degrees Celsius to 450 degrees Celsius; a pressure of from 5000 kilopascals to 20000 kilopascals; a liquid hourly space velocity of from 0.1 per hour to 4 per hour; or a hydrogen feed rate of from 1000 standard liters of hydrogen per liter of hydrocarbon feed to 2500 standard liters of hydrogen per liter of hydrocarbon feed.

A fifteenth aspect of the present disclosure may comprise any one of the twelfth through fourteenth aspects, where the second hydrocracking catalyst comprises a USY-type zeolite.

A sixteenth aspect of the present disclosure may comprise any one of the twelfth through fifteenth aspects, where the operating conditions of the first hydrocracking unit comprise one or more of: a temperature of from 300 degrees Celsius to 450 degrees Celsius; a pressure of from 5000 kilopascals to 20000 kilopascals; a liquid hourly space velocity of from 0.1 per hour to 4 per hour; or a hydrogen feed rate of from 1000 standard liters of hydrogen per liter of hydrocarbon feed to 2500 standard liters of hydrogen per liter of hydrocarbon feed.

A seventeenth aspect of the present disclosure may comprise any one of the twelfth through sixteenth aspects, further comprising passing the second hydrocracked effluent to a heat transfer unit operable to reduce the temperature of the second hydrocracked effluent to produce the cooled effluent.

An eighteenth aspect of the present disclosure may comprise the seventeenth aspect, further comprising passing the cooled effluent to the separation unit.

A nineteenth aspect of the present disclosure may comprise any one of the twelfth through eighteenth aspects, further comprising reducing the severity of the hydrocracking of the hydrocarbon feed, the hydrocracking of the fourth separated effluent, or both, such that an aromatic concentration of the third separated effluent is greater than or equal to 10 weight percent based on the total weight of the third separated effluent.

A twentieth aspect of the present disclosure may comprise any one of the twelfth through nineteenth aspects, further comprising: determining the cetane index, the concentration of aromatics, or both, of the third separated effluent; and modifying one or more operating conditions of the first hydrocracking unit, the second hydrocracking unit, or both, to produce the third separator effluent having a cetane index of from 46 to 70 and a total concentration of aromatic compounds of from 1 weight percent to 30 weight percent based on the total weight of the third separated effluent.

A twenty-first aspect of the present disclosure may comprise any one of the twelfth through twentieth aspects, further comprising: determining the concentration of heavy polynuclear aromatics, the concentration of aromatics, or both, of the second hydrocracked effluent; and modifying one or more operating conditions of the first hydrocracking unit, the second hydrocracking unit, or both, to produce the second hydrocracking effluent having a concentration of heavy polynuclear aromatics of from 50 parts per million by weight to 5000 parts per million by weight and a total concentration of aromatic compounds of from 1 weight percent to 10 weight percent based on the total weight of the second hydrocracked effluent.

A twenty-second aspect of the present disclosure may comprise any one of the previous aspects, where the hydrocarbon feed comprises one or more of vacuum gas oil, demetallized oil, deasphalted oil, coker gas oil, cycle oil, or visbreaker oil.

A twenty-third aspect of the present disclosure may comprise any one of the previous aspects, where the first separated effluent comprises hydrocarbons having an atmospheric boiling point less than 36 degrees Celsius.

A twenty-fourth aspect of the present disclosure may comprise any one of the previous aspects, where the second separated effluent comprises hydrocarbons having an atmospheric boiling point from 36 degrees Celsius to 180 degrees Celsius.

A twenty-fifth aspect of the present disclosure may comprise any one of the previous aspects, where the third separated effluent comprises hydrocarbons having an atmospheric boiling point from 180 degrees Celsius to 370 degrees Celsius.

A twenty-sixth aspect of the present disclosure may comprise any one of the previous aspects, where the fourth separated effluent comprises hydrocarbons having an atmospheric boiling point greater than 370 degrees Celsius.

It is noted that any two quantitative values assigned to a property may constitute a range of that property, and all combinations of ranges formed from all stated quantitative values of a given property are contemplated in this disclosure.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific aspects, it is noted that the various details of such aspects should not be taken to imply that these details are essential components of the aspects. Rather, the claims appended hereto should be taken as the sole representation of the breadth of the present disclosure and the corresponding scope of the various aspects described in this disclosure. Further, it will be apparent that modifications and variations are possible without departing from the scope of the appended claims.

What is claimed is:

1. A two-stage recycle hydrocracking process comprising:

hydrocracking at least a portion of a hydrocarbon feed to produce a first hydrocracked effluent;

separating the first hydrocracked effluent into at least a first separated effluent, a second separated effluent, a third separated effluent, and a fourth separated effluent;

hydrocracking at least a portion of the fourth separated effluent to produce a second hydrocracked effluent; and cooling the second hydrocracked effluent to a temperature less than or equal to 250 degrees Celsius to produce a cooled effluent, where the third separated effluent has a cetane index of from 46 to 70 and a total concentration of aromatic compounds of from 1 weight percent to 30 weight percent based on the total weight of the third separated effluent and the second hydrocracking effluent has a concentration of heavy polynuclear aromatics of from 50 parts per million by weight to 5000 parts per million by weight and a total concentration of aromatic compounds of from 1 weight percent to 20 weight percent based on the total weight of the second hydrocracked effluent; and where the concentration of aromatic compounds of from 1 weight percent to 20 weight percent in the second hydrocracked effluent maintains the solubility of the heavy polynuclear aromatics in the second hydrocracked effluent and reduces precipitation of the heavy polynuclear aromatics in the second hydrocracked effluent.

2. The process of claim 1, further comprising recycling at least a portion of the cooled effluent to the separation system.

3. The process of claim 1, where the hydrocarbon feed comprises one or more of vacuum gas oil, demetallized oil, deasphalted oil, coker gas oil, cycle oil, or visbreaker oil.

4. The process of claim 1, where hydrocracking at least a portion of the hydrocarbon feed comprises introducing the hydrocarbon feed to a first hydrocracking unit operable to contact the hydrocarbon feed with hydrogen in the presence of at least a first hydrocracking catalyst to produce the first hydrocracked effluent.

5. The process of claim 4, where the first hydrocracking catalyst comprises one or more metals from Groups 6-10 of the International Union of Pure and Applied Chemistry Periodic Table of the Elements supported on an amorphous silica-alumina catalyst.

6. The process of claim 4, where the operating conditions of the first hydrocracking unit comprise one or more of:

a temperature of from 300 degrees Celsius to 450 degrees Celsius;

a pressure of from 5000 kilopascals to 20000 kilopascals;

a liquid hourly space velocity of from 0.1 per hour to 4 per hour; or a hydrogen feed rate of from 1000 standard liters of hydrogen per liter of hydrocarbon feed to 2500 standard liters of hydrogen per liter of hydrocarbon feed.

7. The process of claim 1, where separating the first hydrocracked effluent comprises passing the first hydrocracked effluent to a separation unit operable to separate the first hydrocracked effluent to produce at least a first separated effluent, a second separated effluent, a third separated effluent, and a fourth separated effluent.

8. The process of claim 1, where the first separated effluent comprises hydrocarbons having an atmospheric boiling point less than 36 degrees Celsius.

9. The process of claim 1, where the second separated effluent comprises hydrocarbons having an atmospheric boiling point from 36 degrees Celsius to 180 degrees Celsius.

10. The process of claim 1, where the third separated effluent comprises hydrocarbons having an atmospheric boiling point from 180 degrees Celsius to 370 degrees Celsius.

11. The process of claim 1, where the fourth separated effluent comprises hydrocarbons having an atmospheric boiling point greater than 370 degrees Celsius.

12. The process of claim 1, where hydrocracking at least a portion of the fourth separated effluent comprises passing the fourth separated effluent to a second hydrocracking unit operable to contact the fourth separated effluent with hydrogen in the presence of at least a second hydrocracking catalyst to produce the second hydrocracked effluent.

13. The process of claim 12, where the second hydrocracking catalyst comprises a USY-type zeolite.

14. The process of claim 12, where the operating conditions of the second hydrocracking unit comprise one or more of:

a temperature of from 300 degrees Celsius to 450 degrees Celsius;

a pressure of from 5000 kilopascals to 20000 kilopascals;

a liquid hourly space velocity of from 0.1 per hour to 4 per hour; or a hydrogen feed rate of from 1000 standard liters of hydrogen per liter of hydrocarbon feed to 2500 standard liters of hydrogen per liter of hydrocarbon feed.

15. The process of claim 1, where cooling the second hydrocracked effluent comprises passing the second hydrocracked effluent to a heat transfer unit operable to reduce the temperature of the second hydrocracked effluent to produce the cooled effluent.

16. The process of claim 1, further comprising reducing the severity of the hydrocracking of the hydrocarbon feed, the hydrocracking of the fourth separated effluent, or both, such that an aromatic concentration of the third separated effluent is greater than or equal to 10 weight percent based on the total weight of the third separated effluent.

17. A process for reducing or preventing the precipitation of heavy polynuclear aromatics during hydrocracking, the process comprising:

introducing a hydrocarbon feed and hydrogen to a first hydrocracking unit operable to contact the hydrocarbon feed with the hydrogen in the presence of at least a first hydrocracking catalyst to produce a first hydrocracked effluent;

passing the first hydrocracked effluent to a separation unit downstream of the first hydrocracking unit, the separation unit operable to separate the first hydrocracked effluent to produce at least a first separated effluent, a second separated effluent, a third separated effluent, and a fourth separated effluent;

passing at least a portion of the fourth separated effluent and hydrogen to a second hydrocracking unit downstream of the separation system, the second hydrocracking unit operable to contact the fourth separated effluent and the hydrogen in the presence of at least a second hydrocracking catalyst to produce a second hydrocracked effluent; and maintaining the first hydrocracking unit, the second hydrocracking unit, or both, at operating conditions to produce the third separated effluent having a cetane index of from 46 to 70 and a total concentration of aromatic compounds of from 1 weight percent to 30 weight percent based on the total weight of the third separated effluent and the second hydrocracking effluent having a concentration of heavy polynuclear aromatics of from 50 parts per million by weight to 5000 parts per million by weight and a total concentration of aromatic compounds of from 1 weight percent to 20 weight percent based on the total weight of the second hydrocracked effluent, where the concentration of aromatic compounds of from 1 weight percent to 20 weight percent in the second hydrocracked effluent maintains the solubility of the heavy polynuclear aromatics in the second hydrocracked effluent and reduces precipitation of the heavy polynuclear aromatics in the second hydrocracked effluent.

18. The process of claim 17, further comprising reducing the severity of the hydrocracking of the hydrocarbon feed, the hydrocracking of the fourth separated effluent, or both, such that an aromatic concentration of the third separated effluent is greater than or equal to 10 weight percent based on the total weight of the third separated effluent.

19. The process of claim 17, further comprising:

determining the cetane index, the concentration of aromatics, or both, of the third separated effluent; and modifying one or more operating conditions of the first hydrocracking unit, the second hydrocracking unit, or both, to produce the third separator effluent having a cetane index of from 46 to 70 and a total concentration of aromatic compounds of from 1 weight percent to 30 weight percent based on the total weight of the third separated effluent.

20. The process of claim 17, further comprising:

determining the concentration of heavy polynuclear aromatics, the concentration of aromatics, or both, of the second hydrocracked effluent; and modifying one or more operating conditions of the first hydrocracking unit, the second hydrocracking unit, or both, to produce the second hydrocracking effluent having a concentration of heavy polynuclear aromatics of from 50 parts per million by weight to 5000 parts per million by weight and a total concentration of aromatic compounds of from 1 weight percent to 10 weight percent based on the total weight of the second hydrocracked effluent.

* * * * *